United States Patent [19]

Varga

[11] Patent Number: 4,757,575

[45] Date of Patent: Jul. 19, 1988

[54] CARDING ENGINE; AND TO MOVABLE FLATS THEREFOR

[75] Inventor: John M. J. Varga, Halifax, England

[73] Assignee: Carding Specialists (Canada) Ltd., Toronto, Canada

[21] Appl. No.: 378,640

[22] Filed: May 17, 1982

[51] Int. Cl.[4] ..... D01G 15/24

[52] U.S. Cl. ..... 19/103; 19/111

[58] Field of Search ..... 19/102, 103, 111, 113

[56] References Cited

U.S. PATENT DOCUMENTS 3,143,771 8/1964 Kluttz et al. ..... 19/103

FOREIGN PATENT DOCUMENTS 1118662 5/1961 Fed. Rep. of Germany ..... 19/102
1585 of 1855 United Kingdom ..... 19/102
3349 of 1888 United Kingdom ..... 19/102
19292 of 1895 United Kingdom ..... 19/102
344220 3/1931 United Kingdom ..... 19/102
2033936 5/1980 United Kingdom ..... 19/113

*Primary Examiner*—Louis K. Rimrodt
*Attorney, Agent, or Firm*—Henry Sternberg; Bert J. Lewen

[57] ABSTRACT

A carding engine equipped with a series of movable flats (1), each flat being clothed with a plurality of carding elements (2) and having a downwardly facing supporting face (13) at each end of the flat. Each end of each flat is secured to a support member (5) lying below the supporting face, the support member including a support surface (18) engageable with a bend (16) of the carding engine. The flat (1) and support member (5) have been secured together so that the support member is spaced from the supporting face (13) e.g. by a shim (23, 24), such that the distance between the support surface (18) and the plane of the tips of the working carding elements (2) is equal, within a given tolerance, at both ends of all of the flats.

14 Claims, 3 Drawing Sheets

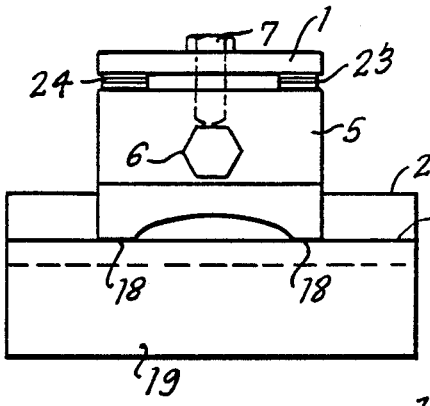
FIG. 2
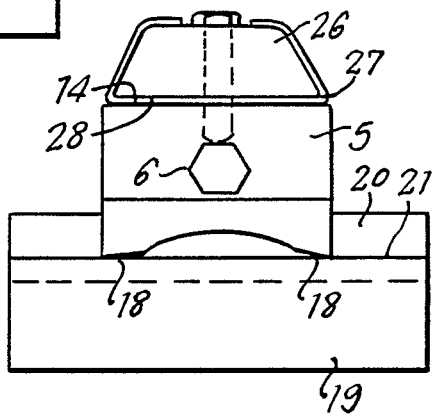
FIG. 4
FIG. 7
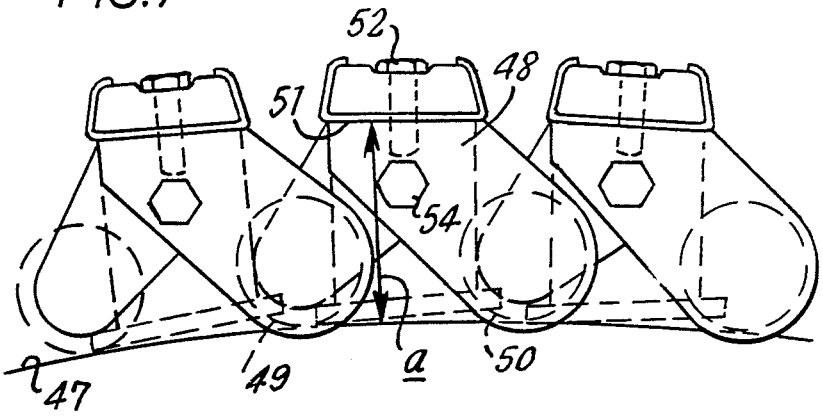

CARDING ENGINE; AND TO MOVABLE FLATS THEREFOR

This invention relates to carding engines and to movable flats therefor.

It is now generally accepted as being extremely desirable for the flats of a carding engine to be set as close as possible to the main cylinder, i.e. for the distance between the tips of the working carding elements on the flats and the tips of the carding elements on the cylinder to be as low as possible. By achieving low settings in this region carded webs of improved quality can be obtained, or for comparable quality with webs from earlier machines increased production rates can be achieved. Settings of 0.007 inch (0.178 mm) or less between the tips of the two sets of carding elements is the ideal goal, but it has heretofore been extremely difficult to achieve such settings with any degree of accuracy, particularly when it is borne in mind that it is necessary to set each individual flat in a series of flats joined together in a continuous chain. Setting methods used in the past have relied upon gauges placed between the carding elements on each flat and the cylinder when that flat is in position on the cylinder and it has been established that settings differing by as much as 0.004 inch (0.102 mm) from flat to flat are not uncommon, particularly if flats have been set by different operators. Clearly, errors of this magnitude cannot be tolerated when the required setting is 0.007 inch (0.178 mm) or less.

The object of the present invention is to provide a flat construction which will enable flats to be standardised before fitting to a carding engine, so making possible the achievement of uniform and accurate small settings for all flats on the carding engine and of many other advantages that are attendant upon the standardisation concept.

According to a first aspect of the invention we provide a carding engine equipped with a series of movable flats, each flat being clothed with a plurality of carding elements and having a downwardly facing supporting face at each end of the flat, and each end of each flat having a support member lying below the supporting face and secured to the end of the flat, the support member including a support surface engageable with a bend of the carding engine, the support member having been secured to the end of the flat at a spacing from the supporting face such that the distance between the support surface and the plane of the tips of the working carding elements is equal, within a given tolerance, at both ends of all of the flats.

The invention also extends to a movable flat for a carding engine, the flat being clothed with a plurality of carding elements and having at each end thereof a downwardly facing supporting face, and spacing means associated with each supporting face whereby a support member having a support surface engageable with a bend of the carding engine can be secured to the end of the flat below the supporting face at a spacing from the supporting face such that the distance between the support surface and the plane of the tips of the working carding elements is, within a given tolerance, equal to a pre-set given distance.

From another aspect the invention resides in a method of preparing a movable flat for use on a carding engine, each flat being clothed with a plurality of carding elements and having a downwardly facing supporting face at each end of the flat, the method comprising supporting the flat on a jig with the tips of the working carding elements in contact with a first surface of the jig and with the supporting faces each overlying a respective second surface of the jig, and setting spacing means below each supporting face such that a support member lying below the supporting face of the flat and having a support surface for engaging a bend of a carding engine will be secured to the respective end at a spacing from the supporting face such that the distance between the support surface and the plane of the tips of the working carding elements is, within a given tolerance, equal to a pre-set given distance.

The invention stems from the concept that support members separate from the body of the flat are provided at each end of the flat when the flat is on the card. Spacing means below the supporting face of each individual flat is selected so that the spacing between the support surface and the plane of the tips of the working carding elements is a fixed distance, within a given tolerance, for all flats. With a plurality of such flats assembled on the bends of a carding engine, with the supporting surfaces of the support members resting on the bends, it follows that, as long as the bend surfaces are uniformly spaced from the tips of the carding wires on the main cylinder, the spacing between the tips of the plane of the working carding elements of each flat and the carding elements on the main cylinder will be uniform within the given tolerance. No adjustment of the flats after assembly on the bends is necessary and all work in achieving proper settings for the flats can be effected off the card. It is found that in practice very low tolerances can be achieved, for example tolerances no more than 0.002 inch (0.050 mm) and desirably of no more than 0.001 inch (0.025 mm).

The effect of this concept of standardisation has quite remarkable advantages.

In a card room, all cards can be standardised and a single stock of standardised flats that will fit all cards can be held. Currently, each card must have its own set of flats, and even then accurate settings from flat to flat on the card cannot be achieved. To attempt to use flats destined for one card on another could prove disastrous. Consequently, using the concept of the invention, very significant savings can be achieved.

When the flats are on the card, consistently uniform settings of only a few thousandths of an inch between the tips of the working carding elements and the tips of the cylinder carding elements can readily be achieved. Carding efficiency can thus be significantly increased. It is thought that the performance of a card is largely dependent on the effect of the first four flats that meet the incoming material, and that variations in uniformity of a carded web leaving the cylinder may in large measure be due to variations in the settings of these first four flats. By realising the very small variations of setting attainable through the invention, the uniformity of the web may thus be considerably enhanced, with consequent improvement in uniformity of sliver condensed from the web. This has particular importance in direct spinning of that sliver.

Replacement of flats on the card becomes a much simpler and more rapid operation than has hitherto been possible. Thus, if a stock of standardised flats is held then it is merely necessary to release an old flat from the card and replace it by one from stock, no further adjustment being necessary once the new flat is on the card. This makes possible the routine maintenance replacement of groups of flats or of flats at spaced intervals throughout a series of flats without the need for extended down times of the carding engine. Such replacement can be of assistance in maintaining a constant level of web quality. Needless to say if any one or more flats become damaged then they may equally easily be individually replaced. Replacement of a whole series of flats or of all flats within a section of the series, in order to handle different materials on the card also becomes readily possible. For example, the setting between the tips of the working carding elements on the flats and the tips of the card cylinder elements need to be very much smaller when processing material such as cotton than they need to be when processing synthetic materials such as polyester. Thus, a card room may be supplied with a set of pre-standardised flats having settings appropriate to cotton and a second set having settings appropriate to polyester, cards being fitted with flats from one or the other set as required. Obviously, there will be down time of the carding engine during such replacement, but that time will be extremely small compared with the very arduous task of completely replacing a conventional set of flats. Certain synthetic materials can be processed with the flats stationary and in such cases it is only necessary to disengage the flat drive, anchor the flats and replace only the flats that lie over the arc of the carding cylinder. By partial replacement, down time is further reduced. Similarly, other different jobs may require different types of flats, and changing of all or part of one standardised set for all or part of another standardised set is equally straightforward.

The jig technique that is used can make accurate setting of the flats on the bends completely non-subjective, in significant contrast to presently used setting methods. It is this that leads to the very high degree of uniformity that is attainable, both within a given card and from card to card. Substantial grinding of the carding elements on new flats designed for conventional use is often necessary in order to ensure that the flat can be set on the bend with clearance within reasonable limits. Utilising the concept of the invention, grinding can be minimised and even eliminated as it is not necessary to remove material from the carding elements in order to standardise the flat setting. This not only minimises the time needed for a grinding operation and the consequent waste of material from the carding elements, but it may again enhance quality, it being widely thought that minimally ground flats carry out more effective carding action. Any grinding that is necessary will generally be carried out after the spacing means has been selected and usually after securing the support members and the flats together. If the support surfaces of the support members are used as a datum during grinding then grinding will be uniform from flat to flat, with no individual flat being either under-ground or over-ground.

Flats according to the invention may be adjusted and have their support members secured thereto while off the cards. Alternatively adjustment may be effected off the card, the flats then being secured to individual pairs of standardised support members already assembled as a continuous chain on the card. When the support members are secured to the flats while off the card then preferably at each end of each flat the support member has been spaced relative to the supporting face by spacing means between that face and the support member before securing the support member to the flat.

Various types of spacing means may be used, for example, micrometer screw techniques or grub screws. Desirably, however, the support member has an upwardly facing top face, the spacing has been effected by the insertion of shim means of selected thickness between the top face and the supporting face, and the support member is secured to the flat by a bolt extending transversely through the supporting face and into a tapped bore in the top face of the support member to bolt the support member, shims and supporting face hard together.

In a further alternative, spacing is effected merely by the selection of a support member of appropriate dimension from a graduated series of support members having dimensions varying by given small increments throughout the required possible range. When the flats are secured to support members already present on the card, then the spacing means at each end of each flat is desirably shim means secured to the flat, the appropriate shim thickness having been selected according to the spacing between the supporting face and the respective second surface of the jig. The shims and the ends of the flats may be designed so that an appropriate shim may simply be clipped to the end of the flat, so standardising that flat for future use.

Whether the flats and support members are assembled together on or off the card the use of shims is particularly preferred, as they lead to an arrangement where the support member, shims and flat end can be bolted hard together to give a robust construction that will maintain the setting indefinitely. By using an appropriate range of go/no-go shims having thickness varying in increments of 0.001 inch (0.025 mm), the spacing between the support surface and the plane of the tips of the carding elements can be set to within 0.002 inch (0.051 mm) from flat to flat, so leading to a tolerance between individual flats of half that figure. Clearly, by using a range of shims that vary in smaller increments even smaller tolerances can be achieved.

There are two generally accepted schools of thought as to the setting of flats in relation to the carding cylinder. The first of these suggests that the spacing between the two sets of carding elements from the leading edge of the flat to the trailing edge of the flat should be as uniform as possible. The other school favours the more usual concept of "heel and toe" setting, wherein the spacing at the leading edge of the flat is less than the spacing at the trailing edge of the flat. The invention is equally applicable to the setting of flats for both types of use, the jig being designed accordingly. For uniform setting all carding elements are potentially working elements and the tips of all elements lie nominally in a common plane parallel to the plane of the supporting face. When shims are used then desirably they will be of uniform thickness between the top face and the supporting face, those faces being parallel. In heel and toe setting only the carding elements at the leading edge of the flat are working elements, even though the tips of all elements lie nominally in a common plane. The plane of the supporting face then desirably makes an angle to that common plane that is appropriate to the heel and toe angle. The tips of the leading edge carding elements then rest on the first surface of the jig the trailing edge tips being supported at a higher level so that the plane of the carding elements is at an angle to the jig surfaces equal to the heel and toe angle. Shims that are used may again be of uniform thickness between parallel top and supporting faces.

The support means may be designed to slide on the bends as in conventional practice, or they may include a rotatable support surface for engaging the bends. The latter substitutes rolling friction for sliding friction and such a support forms the subject of our co-pending application Ser. No. 607,770, filed May 7, 1984. When the support means is designed to be slidable, the invention has a further advantage in that the support member may be made of a material different from that of the rest of the flat and can be designed to have a sliding surface which both slides well, and is wear-resistant.

The invention will be better understood from the following description of specific embodiments thereof, given, by way of example, with reference to the accompanying drawings in which:

FIG. 2 is an end elevation on the arrangement of FIG. 1;

FIG. 4 is a view similar to FIG. 2 showing a second embodiment of flat;

FIG. 7 shows the flat of FIG. 5 in position on a carding engine.

Figure 1:
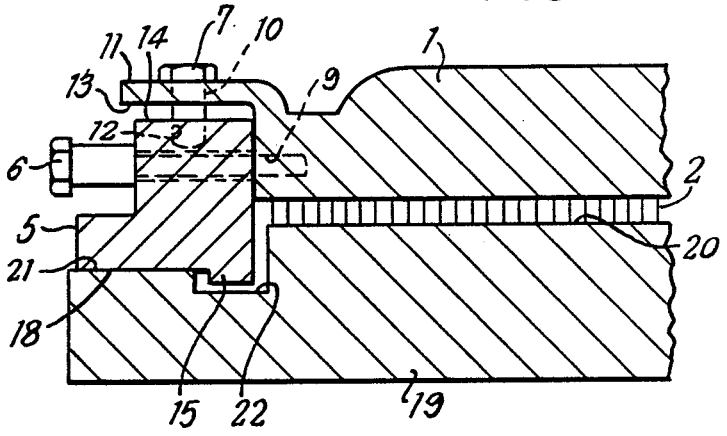
FIG. 1 is a cross-section of a first embodiment of flat and associated setting jig.
Figure 3:
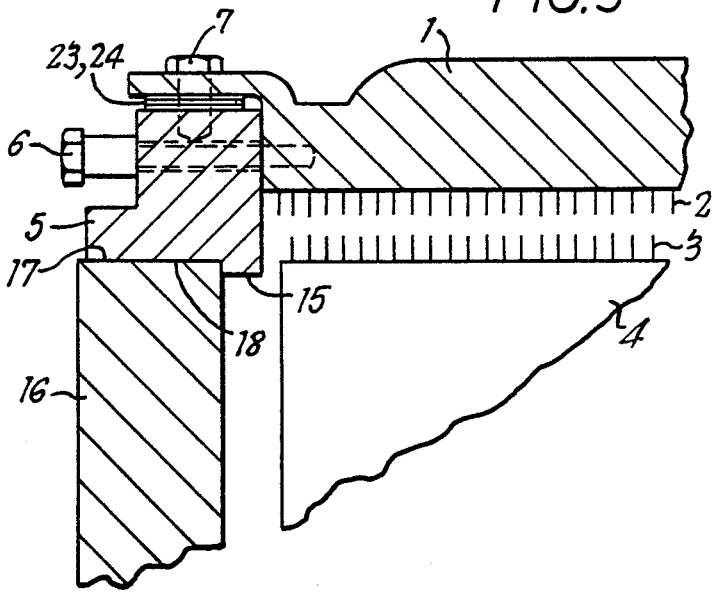
FIG. 3 shows the flat of FIG. 1 in position on a carding engine.

Referring now to FIGS. 1 to 3 these show a movable flat 1 for a carding engine, the flat having a main body, the lower surface of which is clothed with carding elements 2 which in use face towards and run adjacent to the carding elements 3 on the surface of a carding cylinder 4. The flat has a support block 5 at each end thereof, the support block being separate from the remainder of the flat and secured thereto by an adjustable bolt assembly comprising bolts 6 and 7. The bolt 6 extends through an enlarged bore 8 in the support block into a tapped bore 9 in the body of the flat 1. The bolt 7 extends through a hole 10 in a flange 11 at the end of the flat and extends into a tapped bore 12 in the support block. The flange 11 has a lower supporting face 13 which overlies a parallel top face 14 of the support means. The lower surface of the support block has a downwardly projecting part 15 which in use engages against the inner surface of the bend 16 of a carding engine, as shown in FIG. 3, the lower surface 18 of the support block 5 forming a support surface that runs in sliding contact with the bearing surface 17 of the bend.

Techniques are available for achieving a high degree of accuracy in the spacing between the tips of the carding elements 3 on the cylinder and the bearing surface 17 of the bends around the whole extend of the bends, which usually subtend an angle of from 120° to 140° at the axis of the main cylinder. If, therefore, the flats can be formed so that the distance between the plane of the tips of the teeth of the carding elements 2 and the plane of the support surface 18 which rests on the bearing surface 17 of the bend, can be set to be substantially equal from flat to flat, then the clearance between the tips of carding elements on the flats and on the cylinder will, when the card is assembled, be equal within a given tolerance. The invention can be used to achieve this objective as follows.

Before the flats are assembled on the carding engine each flat is individually set using a jig as shown in FIGS. 1 and 2. The jig 19 has a first plane surface 20 and second end plane surfaces (only one of which is shown) parallel to the surface 20 and separated therefrom by a groove 22. To assemble a flat the main body of the flat is placed on the jig so that the tips of the carding elements 2 rest on the surface 20 of the jig. It will be appreciated that there will be some small variation between the individual carding elements so that the tips of all the teeth will not be exactly coplanar. However, the setting will be based on the longest carding elements, as indeed is the required condition. The flat 1 is then held gently against the jig, without deforming the carding elements, by any suitable means (not shown). At each end of the jig (and only one end is shown as the technique is identical at each end) a support block is placed on the jig so that the surface 18 of the block rests in contact with the respective second surface 21 of the jig, the projection 15 from the block lying in the groove 22. The bolt 6 is inserted through the enlarged bore 8 in the block and screwed into the tapped bore 9 to hold the block loosely against the end of the main body 1 of the flat as shown in FIG. 1. The support block 5 is then also clamped to the jig, again by means not shown. The bolt 7 is then inserted through the flange 11 to engage the tapped bore 12 in the top surface 14 of the support block 5. Shims 23, 24 are inserted between the lower supporting face of the flange and the top surface of the support block as required to substantially fill the gap between the two faces. The distance between the planes of the first and second surfaces 20 and 21 of the jig has of course been designed in accordance with the required setting, as those surfaces dictate the relative positions of the main body and end support blocks of the flats. By suitable use of graduated go/no-go shims the spacing between the two surfaces 13 and 14 can be set to within very low tolerances. When the shims are in position the bolt 7 is tightened hard and the flat can then be placed on the bends of a carding engine as shown in FIG. 3. At that stage the bolt 6 can be loosened and can be used to connect the flat to the flat chains and then retightened.

Every flat required for the set of flats of a carding engine, and desirably for all carding engines in a card room, is desirably set on the same jig. Thus, while on the jig the distance between the support surface 18 and the tips of the working carding elements 2 is equal. If the space between the faces 13 and 14 could then be filled exactly by shims then the distance between the support surface and the carding element tips for every one of the flats would be identical. However, this is recognized as impractical and in practice a series of graduated go/no-go shims are provided, shims of different thickness being provided in increments of, say, 0.001 inch (0.025 mm). Thus, the maximum variation in total shimming from one flat to another will be the thickness of two shims, and the spacing between the support surface and the carding element tips will thus be of the required given figure plus or minus a shim thickness. With all flats pre-set to this standard of accuracy no problems are encountered in mounting the flats on a carding engine to obtain settings as low as 0.007 inch (0.178 mm) substantially uniformly around the entire working arc of the carding cylinder. Furthermore, by adopting for the bearing surfaces 17 of the bends and the sliding surfaces 18 of the support blocks a material or a surface treatment that promotes easy sliding and little wear, problems due to loss of settings because of excessive wear can be overcome.

FIG. 4 shows an alternative method of effecting shimming between the flat end and the support member while these are on a jig. Parts identical to those shown in FIG. 2 are given the same reference numbers. In this embodiment the shape of the end of the flat is different, although it still has a downwardly facing supporting face 26. The shims 27 that are used are of a clip-on type which slide onto and clip over the end 28 of the flat. After the shim has been selected that will fit most closely into the gap between the faces 27 and 14 the assembly is secured by the bolt 7. FIG. 4 also indicates that the support surfaces 18 of the support block 5 can be pre-chamfered prior to assembly of the flat. The bearing surface 17 of the bend is a large diameter cylinder and if the support surfaces 18 are parallel as shown in FIG. 2 they will, in use, gradually wear to conform to that cylindrical surface. If such wear occurs evenly then all flat settings will change slightly by the same amount at the same time. By using pre-chamfering as shown in FIG. 4 the degree of wear necessary is substantially reduced and even if wear occurs unevenly from flat to flat the effect on differences in flat setting is negligible. Wear could of course be virtually eliminated by pre-grinding the surfaces 18 to the bend diameter but this is not really necessary.

FIGS. 1 to 4 show arrangements wherein the flats are designed to be used so that the spacing between the cylinder carding elements and the carding elements on the flat from the leading edge to the trailing thereof is as uniform as possible. Accordingly, the jig first and second surfaces 20 and 21 are parallel, the faces 13 and 14 (or 26 and 14) are as closely parallel as possible and the shims are substantially equal thickness to each side of the bolt 7. To provide flats that will have a "heel and toe" setting when on the carding engine any one of a number of different techniques may be adopted and FIGS. 5 and 6 illustrate one such technique for a different type of flat.

The jig used in this embodiment comprises a centre section 30 and two similar end sections such as 31. The centre section has a longitudinally extending rear wall 32 projecting above the level of the surface 33 of that section. The rear wall 32 includes a downwardly inclined surface 34, the angle of inclination of the surface 34 to the surface 33 being equal to the required heel and toe angle for the flat. Each end section 31 of the jig has an upper surface 35 that is parallel to the surface 33.

This jig is used to standardise a heel and toe flat having a body 36, the lower surface of which is furnished with card clothing 37. The body is formed with two similar ends such as the end 38, and each end has a downwardly facing support face 39. The angle between the plane of the support face 39 and the plane of the tips of the carding elements is equal to the heel and toe angle. Each end has a bore 40 formed therethrough and two locating projections 41, 42 formed at its outer end. A tapped bore 43 extends into each end of the body 36.

Figure 5:
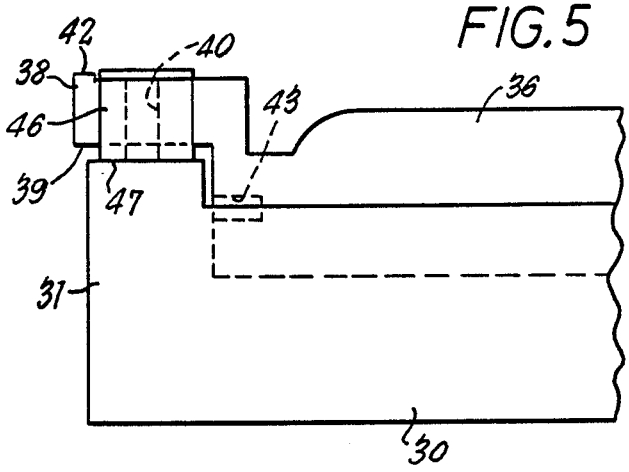
FIG. 5 and FIG. 6 are views similar to those of FIGS. 1 and 2 showing a third embodiment of flat and associated setting jig.
Figure 6:
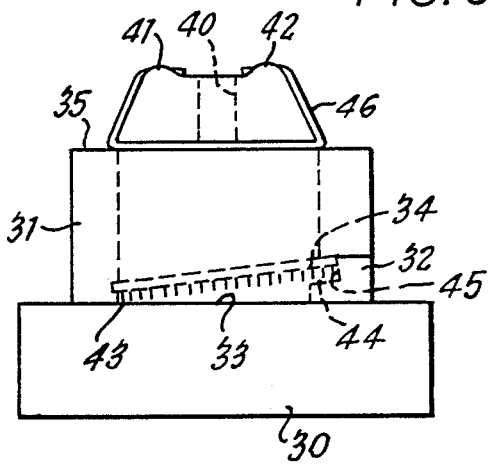

In order to standardise a flat using this jig the flat is placed on the jig as shown in FIGS. 5 and 6 with the leading edge 43 of the carding elements resting on the surface 33 and the trailing edge 44 of the carding elements being supported on the surface 34, the trailing edge of the flat being located against the stop surface 45. Each end section 38 of the flat projects above the surface 35 of the respective end sections 31 or 32. A shim 46 selected from a graduated series of go/no-go shims to be the largest that will fit between the surfaces 39 and 35 is selected and inserted into that space. The shim is designed so that it will clip onto the end 38 of the flat and once in position will be retained on the flat by the projections 41 and 42. The flat can then be removed from the jig, the fitting of the appropriate shim having standardised the flat so that the distance between the lower surface 47 of the shim and the leading part 43 of the carding elements is at the required figure, within a tolerance dictated by the increments of the shim.

FIG. 7 shows a shimmed flat in position on a carding engine having on each bend 47 a pre-assembled chain of support members 48 each supported by wheels 49, 50 on the respective bend. The support members have been manufactured so that the distance between a common tangent plane to the wheels 49 and 50 and the plane of the top surface 51 of the support member, distance a, is the same from one support member to another. Each shim is secured to support members at the side of the card by placing the end 38 of the shim onto the surface 51 of the support member, inserting a bolt 52 through the bore 40 and shim and tightening the bolt into a tapped bore 53 in the support member to bolt the flat hard to the support member. An additional bolt 54 may then be passed through an enlarged bore in the support member and into the tapped bore 43 in the body of the flat 36. It will be seen that when the flat is secured to the support members in this way the heel and toe setting of the carding elements relative to the card cylinder is preserved.

In the embodiment of FIGS. 5 and 6 the surface 35 of the jig is shown as being parallel to the surface 33. If desired the surface 35 may make a small angle to the surface 33 in the opposite direction to the angle between surfaces 33 and 34. This may make it easier to fit and accommodate shims and will not affect the critical setting of the working carding elements 43 as the effect when such a shimmed flat is secured to support members 48 will merely be to lift slightly the trailing end of the flat.

It will be understood that the jigs described are only exemplary and that other jigs can readily be designed. Similarly, other types of support assemblies at the ends of the flat may be utilised and the adjustment and settings means may differ from that shown. The particular examples described rely upon the use of shims for obtaining and maintaining the desired setting, and various shim dispositions are shown. It will be apparent that other arrangements can be used, for example two spaced bolts one at each side of the end of the flat, each bolt having its associated shims. The drawings show use of shims of uniform thickness. In certain instances, however, for example to compensate for machining error, shims of non-uniform thickness may be used. Alternatively, micrometer settable and lockable bolts could be used. As an alternative to shims, these could be replaced by grub screws which are adjustably settable and which work against the direction of clamping of the main bolt. Rather than use shims or adjusting means, spacing can be effected by selection of a support member from a series of graduated support members varying in size by appropriate increments. Other spacing and locking methods will be apparent to those skilled in the art.

In the examples described the support face of the flat is formed on an end section of the flat that is integral with the remainder of the flat. In an alternative construction that support face may be formed on a separate end piece that is bolted or otherwise secured to the main body of the flat.

I claim:

1. In a carding engine equipped with a series of movable flats, each flat being clothed with a plurality of carding elements and having a downwardly facing supporting face at each end of the flat, the improvement comprising individual spacing means associated with each end of each flat, each flat having a support member lying below the supporting face and secured to the end of the flat, the support member including a downwardly facing support surface engageable with a bend of the carding engine and an upwardly facing top face, and the spacing means comprising shim means of individually selected thickness lying between the top face of the support member and the supporting face of the flat, and means securing the support member to the end of the flat with said shim means held in contact both with the top face of the support member and with the supporting face of the flat, each shim means being selected so that the distance between the support surface and the plane of the tips of the working carding elements is equal, within a given tolerance, at both ends of all of the flats.

2. A carding engine according to claim 1 in which the shim means is clipped onto the end of the flat to be retained thereon.

3. A carding engine according to claim 1 in which the support member is secured to the flat by a bolt extending transversely through the supporting face and into a tapped bore in the top face of the support member to bolt the support member, shims and supporting face hard together.

4. A carding engine according to claim 3 in which the support member is also secured to the flat by a second bolt extending transversely to the first said bolt through a bore in the support member and into a tapped bore in the end of the flat, the bore in the support member being of greater diameter than the second bolt.

5. A carding engine according to claim 3 in which the shim means is of uniform thickness between the top face and the supporting face, which faces are parallel.

6. A carding engine according to claim 1 in which each support surface is slidable on the bend.

7. A carding engine according to claim 1 in which each support surface is rollable on the bend.

8. A movable flat according to claim 1 in which the shim means is a shim clipped to the end of the flat.

9. A movable flat for a carding engine, the flat being clothed with a plurality of carding elements and having at each end thereof a downwardly facing supporting face, a support member having a downwardly facing support surface engageable with a bend of the carding engine and an upwardly facing top face, shim means of individually selected thickness lying between the top face of the support member and the supporting face of the flat, and means securing the support member to the end of the flat with said shim means held in contact both with the top face of the support member and with the supporting face of the flat.

10. A movable flat according to claim 9 in which a bolt extends transversely through the supporting face and into a tapped bore in the top face of the support member to bolt the support member, shim means and supporting face hard together.

11. A movable flat according to claim 10 in which the support member is also secured to the flat by a second bolt extending transversely to the first said bolt through a bore in the support member and into a tapped bore in the end of the flat, the bore in the support member being of greater diameter than the second bolt.

12. A method of preparing a series of movable flats for use on a carding engine, each flat being clothed with a plurality of downwardly facing carding elements and having a downwardly facing supporting face at each end of the flat, the method comprising supporting each flat on a jig with the tips of the working carding elements in contact with a first surface of the jig and with the supporting faces each overlying a respective second surface of the jig, securing individually selected shim means beneath each supporting face with an upper face of each shim means in contact with the respective supporting face, each shim means being selected so that the distance between a lower face thereof and the plane of the tips of the carding elements is equal, within a given tolerance, at both ends of all the flats, securing a support member below the supporting face of each end of each flat, each support member having a downwardly facing support surface for engaging a bend of a carding engine and an upwardly facing top face, the distance between the support surface and the top face being substantially equal for all the support members, each support member being secured with the top face thereof in contact with the lower face of the shim means, and assembling the flats on the carding engine with the support surfaces of the support members in contact with the bends of the carding engine.

13. A method according to claim 12 in which the shim means is clipped to the end of the flat.

14. A method according to claim 12 in which the support member is secured to the flat by a bolt extending transversely through the supporting face and into a tapped bore in the top face of the support member to bolt the upper member, shims and supporting face hard together.

* * * * *